US005822936A

United States Patent [19]

Bateman

[11] Patent Number: 5,822,936

[45] Date of Patent: Oct. 20, 1998

[54] INTERCONNECT SYSTEM FOR MODULARLY FABRICATED BULLET STOPS

[76] Inventor: Kyle E. Bateman, P.O. Box 636, Provo, Utah 84603

[21] Appl. No.: 375,618

[22] Filed: Jan. 20, 1995

Related U.S. Application Data

[63] Continuation-in-part of Ser. No. 8,792, Jan. 25, 1993, abandoned.

[51] Int. Cl.[6] ..... E04B 1/38; F41H 5/24; F41J 1/20

[52] U.S. Cl. ..... 52/281; 52/282.1; 52/282.5; 52/285.2; 52/276; 52/460; 52/463; 52/584.1; 52/762; 89/36.01; 89/36.04; 109/1 R; 109/49.5; 109/79; 109/82; 109/85; 273/410

[58] Field of Search ..... 52/584.1, 281, 52/267, 275, 276, 285.1, 285.2, 403.1, 459, 460, 461, 282.1, 282.2, 282.4, 282.5, 463, 762; 89/36.01, 36.02, 36.03, 36.04; 273/404, 407, 410, 406; 109/1 R, 1 S, 9, 49.5, 58, 78, 79, 80, 82, 85

[56] References Cited

U.S. PATENT DOCUMENTS

| | | | |
|---|---|---|---|
| 774,959 | 11/1904 | Tresidder | 109/78 |
| 980,255 | 1/1911 | Herms et al. | 52/459 X |
| 1,035,908 | 8/1912 | Richardson | 109/78 |
| 1,155,717 | 10/1915 | Fouts . | |
| 1,199,357 | 9/1916 | Evans, Jr. . | |
| 1,803,514 | 5/1931 | Thomas . | |
| 1,957,933 | 5/1934 | Brandl | 52/762 X |
| 2,054,665 | 9/1936 | Tracy | 52/282.1 X |
| 2,105,784 | 1/1938 | Hagberg . | |
| 2,170,637 | 8/1939 | Hatch et al. . | |
| 2,208,010 | 7/1940 | Whitmore | 52/282.5 X |
| 2,209,580 | 7/1940 | Sargent . | |
| 2,212,982 | 8/1940 | Drain, Jr. et al. | 52/275 X |
| 2,231,528 | 2/1941 | Daniels . | |
| 2,269,490 | 1/1942 | Slick | 52/281 X |
| 2,350,827 | 6/1944 | Saulnier | 52/584.1 |
| 2,412,242 | 12/1946 | Beaud | 52/276 X |
| 2,628,388 | 2/1953 | Poth . | |
| 2,927,665 | 3/1960 | Hauf | 52/584.1 X |
| 2,932,860 | 4/1960 | Barth | 52/275 X |
| 3,423,891 | 1/1969 | Burris . | |
| 3,485,405 | 12/1969 | Dement | 52/282.5 X |
| 3,530,633 | 9/1970 | Scott | 52/584.1 X |
| 3,969,855 | 7/1976 | Lendi | 52/460 X |
| 4,028,856 | 6/1977 | Dlabec | 52/281 |
| 4,254,600 | 3/1981 | Zwissler | 52/281 |
| 4,677,798 | 7/1987 | Phillips | 109/79 X |
| 4,856,791 | 8/1989 | McQuade | 273/410 |
| 5,400,692 | 3/1995 | Bateman . | |

FOREIGN PATENT DOCUMENTS

| | | | |
|---|---|---|---|
| 127432 | 4/1948 | Australia | 52/281 |
| 202340 | 7/1956 | Australia | 52/282.5 |
| 832754 | 10/1938 | France | 52/285.2 |
| 849829 | 12/1939 | France | 52/282.5 |
| 1156211 | 5/1958 | France | 52/285.2 |
| 2461069 | 1/1981 | France . | |
| 227342 | 10/1910 | Germany | 52/285.2 |
| 498308 | 5/1930 | Germany | 52/463 |

(List continued on next page.)

OTHER PUBLICATIONS

"United Steel Sash", Trussed Concrete Steel Co., 1 sheet, 1903.

*Primary Examiner*—Carl D. Friedman
*Assistant Examiner*—Laura A. Callo
*Attorney, Agent, or Firm*—Thorpe, North & Western, L.L.P.

[57] ABSTRACT

An interconnect system for modularly fabricating bullet stops is disclosed including a plurality of bullet proof plates which are placed adjacent one another to form a seam which is covered by a facing strip. A plurality of bolts extend through the facing strip and through a backing mechanism positioned on an opposite side of the plates. When the bolts are tightened, the facing strip and backing pull towards one another and hold the plates together. The facing strips and other teachings of the invention allow standard plates to be used rather than large and specially manufactured plates.

13 Claims, 3 Drawing Sheets

FOREIGN PATENT DOCUMENTS

| | | | |
|---|---|---|---|
| 514123 | 12/1930 | Germany . | |
| 877489 | 5/1953 | Germany | 52/276 |
| 2021170 | 11/1971 | Germany | 52/282.5 |
| 3635741 | 7/1992 | Germany | 89/36.02 |
| 7700295 | 7/1978 | Netherlands . | |
| 597451 | 4/1978 | Switzerland | 52/282.5 |
| 280832 | 11/1927 | United Kingdom . | |
| 725189 | 3/1955 | United Kingdom | 52/461 |

INTERCONNECT SYSTEM FOR MODULARLY FABRICATED BULLET STOPS

This application is a continuation-in-part of application 08/008,792 filed Jan. 25, 1993, now abandoned.

BACKGROUND

The present invention relates to a connection system for fabricating bullet stopping structures, such as bullet traps, baffles, training simulators, targetry and the like, from standard plate.

"Plate" as used herein means planar fabrications made from metal and metal alloys which are chosen for their ability to stop the forward progress of projectiles in an efficient manner. It will be appreciated by one of ordinary skill in the art that hardening and tempering are often used to enhance this desired property in many plate products. It will also be appreciated by one of ordinary skill in the art that weight, hardness, wear and many other relevant factors will be considered in selecting the proper plate material.

It is desirable to fire handguns, rifles, shotguns and the like in a controlled and controllable environment. Such an environment is desired for, for example, police, military, other institutional training exercises; sporting users for practice shooting; target shooting; and, test firing of firearms. In these and other such applications it is desirable to create an environment which simulates the area of actual use, such as a crime scene for police training, without unnecessarily compromising health, safety or property by limiting the possible array of continuing trajectories of fired bullets. It is also desirable to make such facilities cost effective.

Primarily because of production costs, such environmental "enclosures" have been traditionally limited to backstops for stationary targetry. This does not allow realistic firearms training and sport scenarios such as "surprise," moving and reactive targets and interactive training. A fabrication technique which allows fabrication of such realistic and large scale, even three dimensional, bullet stops would be desirable.

A fabrication technique which allows the use and re use of materials is also desirable, but heretofore unavailable. For example, a certain training scenario may require training in a given simulation such as a re-creation of a building or street setting. After the scenario is no longer relevant, or when training in that scenario is complete, it would be desirable to disassemble the bullet stop and reuse the components in another bullet stop.

It is known to make use of plate to stop the movement of projectiles. Of course, whenever a firearm is intentionally fired, it has a desired path or zone of travel. When a projectile travels beyond the desired path or zone, or when an undesired discharge or a deviant path is encountered, it is desirable to arrest its movement in order to maintain the personal safety of participants, instructors and bystanders, and to protect against property damage. Plate barriers are known and used for this purpose.

The acceptance and use of plate barriers for containment purposes has been frustrated by fabrication limitations. The demand for more realistic simulations and increasingly functional facilities has been unsatisfied, primarily because of perceived limitations in the fabrication of plate into usable structures. For example, the fabrication of structures from sheet material is currently accomplished by the use of elongate fasteners which extend through holes in the sheets, such as bolts rivets or nails. It is also known to weld adjoining sheets together. These fabrication techniques are not well adapted, however, for structural fabrication using plate.

Welding disrupts the desired qualities of the plate by introducing large quantities of heat to the material. For example, if two hardened steel plates are joined by welding, a given zone around the weld will be less resistant to penetration by projectiles, thereby increasing the risk of hazard or property loss due to compromise of the plate upon impact.

By their very nature, appropriately selected plate materials which stop the travel of bullets are resistant to penetration. This quality severely limits fabrication techniques requiring holes. Holes made by a fastener such as a nail are out of the question. Attempts have been made to cut holes in the material on-site by using a cutting torch, but this induces the same weakness in the metal caused by welding. Drilling these materials is impractical if not impossible. Formation of holes in plates during the manufacturing process is also known. This only allows, however, fabrication of designs anticipated prior to manufacture of the plate. It is possible to manufacture plates with a large number of holes in order to afford flexibility in fabrication, but an excess number of holes in plate has obvious drawbacks, as does manufacture of plate with the wrong size of holes. Furthermore, if plate is manufactured with holes in it in anticipation of fabrication requirements, it is only useable for specified applications. Such plate cannot be stored and used as cost effectively as standard planar sheets of the same material.

Bends, folds, and other possibly desirable deviations from flat planar sheet materials can also be manufactured in the material. This, however, adds significant cost to the manufacture, shipping and storage costs of the material and, as explained above, decreases the fungibility and overall value of the materials.

Plate materials can be ordered in a range of sizes. The lack of acceptable fabrication methods motivates the purchase of larger sheets which are then cut to the various desired sizes. This too has drawbacks. The most practical method of cutting plate materials is to use a cutting torch. This has the same disadvantages of welding, that is, compromising the desired qualities of the selected plate materials and the attendant potential for material failure within a given zone. This disadvantage leads to the purchase of smaller portions of plate, but this requires multiplication of the number of interconnects using conventional techniques. Either way, known methods of fabrication have not resolved the need in the art for an effective interconnect means for attaching standard sized plates to form a variety of bullet stops.

With the known custom-type fabrication techniques such as welding, cutting and special manufacturing, the components of a bullet stop are not readily transportable or re-usable. Bullet stopping structures are sometimes of a significant scale. When such structures are no longer needed or functional, dismantling them can be a significant and costly task involving reversal of the complex fabrication techniques and disposal of large scale scrap which cannot be reused for its original purpose.

Fabrications using known techniques such as welding, cutting, and specially manufactured plates also have the drawback of wear. A given material has a finite life expectancy under given wear conditions. Certain portions of such a fabrication see more wear than others, or they may become unserviceable due to misuse or latent defects. Known fabrication techniques have the disadvantage of requiring service of these parts in accordance with their original manufacture, i.e. more cutting, welding, or special manufacture. This also means revisiting the costs of transport of bulky and irregular items or the additional compromise of the desired qualities of the materials used. As will be appreciated, the life expectancy of bullet stop properly fabricated according known techniques may be many years. If the original custom fabricator is not available to do repair work, the owner must incur the additional cost of educating a new artisan as to the techniques used in fabrication and/or the source of custom manufacture of component parts.

In light of the problems of the prior art, there is a need for a system which allows fabrication and re-fabrication of bullet stops from standard reusable, replaceable plates without the problems attendant to welding, cutting, special manufacture of component parts and direct fastening through holes in the respective plates. While such systems have been impossible in the past, the present invention provides both a method and structure which enables bullet stops to be formed on-site from standard plates and re-constructed using standard components.

SUMMARY OF THE INVENTION

It is an object of the present invention to provide a bullet stop and method for fabricating the same from standard plate materials without drilling cutting or welding the plate materials.

It is another object of the present invention to provide such a bullet stop and method which enables the plates of the stop to be assembled into custom bullet stops at the point of use.

It is still another object of the invention to provide a bullet stop and method for assembling bullet stops which does not require custom manufactured plate materials.

It is yet another object of the invention to provide a bullet stop and method of fabrication of the same from standard materials which can be easily assembled disassembled and re-constructed using standard parts and standard plates.

It is a further object of the invention to provide a bullet stop and method of fabrication of bullet stops in which worn, damaged or defective plates can be replaced from an inventory of standard plates.

The above, and other objects of the invention, are achieved in an interconnect system for modularly fabricating bullet stops having a plurality of connection mechanisms for securing together several standard plates so as to function as a bullet stopping structures, such as bullet traps, baffles, training simulators, dynamic targetry backstops and the like. The connection mechanism holds the plates securely together and prevents bullets and fragments thereof from escaping between them.

In accordance with one aspect of the invention, the connection mechanism includes two cover strips, one of which is placed on each side of a channel formed by placing two standard plates adjacent one another. The two strips prevent bullets and fragments from slipping between the adjoining plates.

In accordance with another aspect of the invention, an energy absorbing or sealant compound or rigid spacer can be placed in the channel between each pair of adjoining plates so as to inhibit the movement of any bullet fragments which may enter the channel, define the channel and to damp the transfer of vibrational energy between the plates, to thereby decrease noise.

In accordance with yet another aspect of the present invention, the connection mechanism includes shims which enable the adjoining plates to be held together at transverse angles.

In accordance with still another aspect of the invention, some of the cover strips include attachment mechanisms for hanging a construct fabricated from plates, so as to form a suspended bullet arresting baffle.

BRIEF DESCRIPTION OF THE DRAWINGS

The above, and other objects, features and advantages of the invention, will become apparent from a consideration of the following detailed description presented in connection with the accompanying drawings, in which.

DETAILED DESCRIPTION

Figure 1:
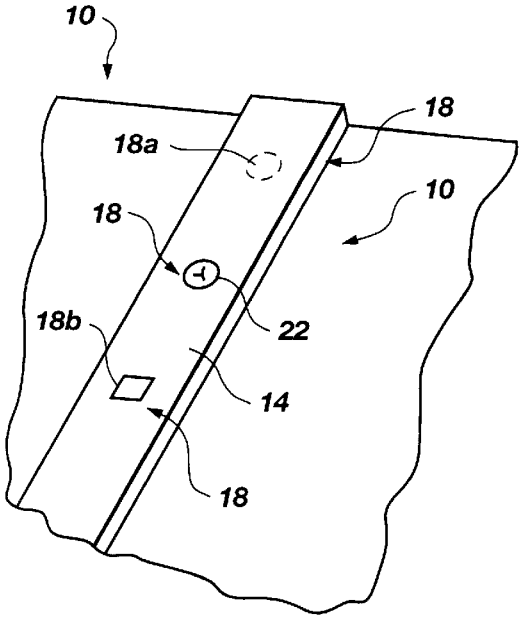
FIG. 1 shows a fragmented front perspective view of an embodiment of an interconnect system for modular fabrication of bullet stop made in accordance with the principles of the present invention.

Reference will now be made to the drawings in which the various elements of the preferred embodiment of the present invention will be given numeral designations and in which the invention will be discussed so as to enable one skilled in the art to make and use the invention. Referring to FIG. 1, there is shown a fragmented perspective view of adjacent plates, generally indicated at 10, and a facing strip 14. Those skilled in the art will appreciate that fabrications using plate materials present special concerns which have previously prevented the modular construction of bullet stops with connected plates. Plate materials cannot be drilled using conventional techniques because of their hardness and cannot be welded or cut without loosing their temper.

Thus, the facing strip 14 can be made of conventional or other suitable and low cost metal, such as steel or iron which can be drilled or punched as well as manufactured of hard material. The facing strip 14 is typically about 45 mm to 55 mm wide, 5 mm to 15 mm thick and has a length roughly the height of the standard plate 10 to be joined. As will be appreciated, the length of the plates 10 will depend on the application. For example, when the plates will be used to form a suspended baffle for an enclosed shooting range, each piece 10 may be about twenty feet long. In other uses the length may be shorter.

A plurality of holes 18 are drilled or punched into the facing strip 14. The holes may be round, as shown at 18*a*, square 18*b*, or some other shape which accommodates a desired bolt head such as a plow bolt or other flush-headed fastener. The holes 18 are spaced at approximately 200 mm to 300 mm intervals. As shown in FIG. 1, a plow bolt 22 is nested in a hole 18 so that the end surface of the plow bolt is flush with the facing strip 14. It will be appreciated that other fasteners could also be used. The plow bolt 22 extends through the facing strip 14, through a channel (not shown) between the adjacent plates, and into a washer (not shown) or some other securing devices.

The facing strip 14 is disposed on the side of the fabrication intended to be fired upon. This strip can be fabricated from either relatively soft materials or manufactured from hardened materials with the desired configuration. Soft materials can be effectively used because the thickness of the material can be adjusted to insure the desired bullet resistance. The use of manufactured hardened materials for facing strips does not add significantly to the cost of a construct or the cost of transport because they are a minor fabrication element in terms of overall content. The channel gap between adjacent plates is quite narrow, thus restricting the possible passing of a bullet between them. The facing strip can be constructed of much thicker material than the plates, further limiting the possibility that a bullet could pass through. Thickening the facing strips has little relation impact on the total cost of a fabrication.

Figure 2:
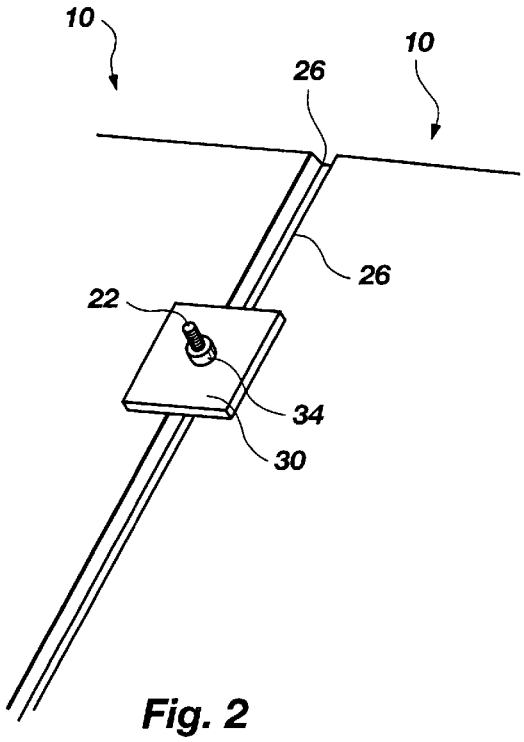
FIG. 2 shows a fragmented rear perspective view of an embodiment of the interconnect system for modular fabrication made in accordance with the principles of the present invention.

Referring now to FIG. 2, there is shown a backside view of the embodiment shown in FIG. 1. As was mentioned, a channel 26 is formed between the plates 10 which are positioned coplanar with one another. This is due to the fact the plates 10 cannot be drilled or welded as set forth above. Thus, lateral edges of the plates are juxtaposed and positioned to form a small channel 26 for the bolt 22 to extend between the plates 10.

A backing washer 30 made of flat iron or some similar material is placed on the backside of the plates 10 so that the plow bolt 22 will pass therethrough. A nut 34 is then attached to the plow bolt 22 and tightened until the backing washer 30 and the facing strip 14 are held firmly against the plates 10. When the nut 34 has been tightened sufficiently, the facing strip 14 and the backing washer 30 hold the plates 10 in rigid attachment. The combined plates 10 can then be used for baffles, bullet traps and other bullet stopping environmental construction in the same way a larger piece of plate would conventionally be used.

Figure 3:
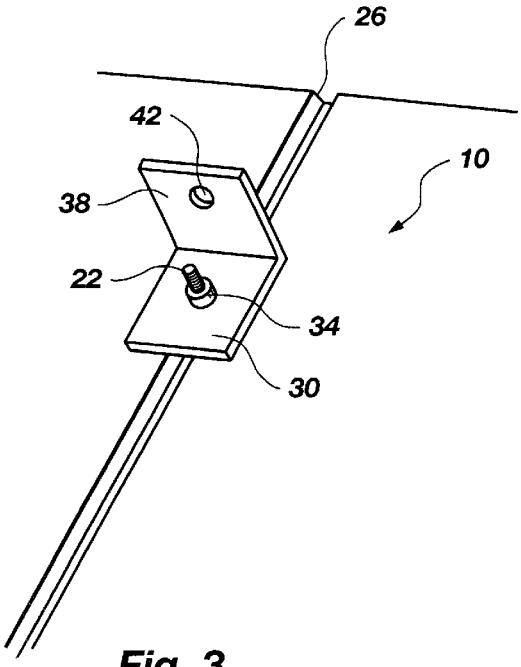
FIG. 3 shows a fragmented rear perspective view similar to that shown in FIG. 2, wherein a support washer includes a suspension mechanism for suspending adjoining plates.

Referring now to FIG. 3, there is shown an embodiment similar to that shown in FIG. 2, but further including a suspension mechanism. The plates 10 are held together by the facing strip (not shown) and the backing washer 30, due to force applied by the plow bolt 22 and the nut 34. The backing washer 30 has a flange 38 extending generally perpendicular thereto, but the flange could extend at other angles. The flange 38 may be welded to the backing washer 38, or formed integrally therefrom. The flange 38 has a hole 42 formed therein to provide a point of attachment for suspending the joined plates 10. Typically, a chain or steel cable (not shown) is attached through each hole 42 and then attached to supporting walls or ceiling. Two attachment points per joint are used to suspend a given fabrication. Similar attachment points are attached using similar means with spacers substantially for one plate at the terminal edge of each terminal plate.

Figure 4:
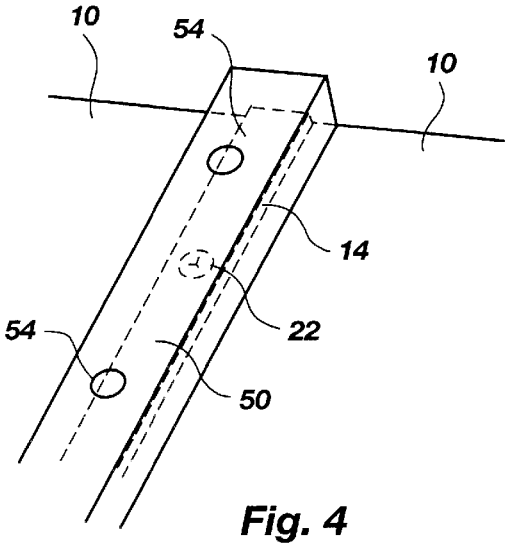
FIG. 4 shows a fragmented perspective view of one embodiment of the present invention, with a wood support member attached thereto.
Figure 5:
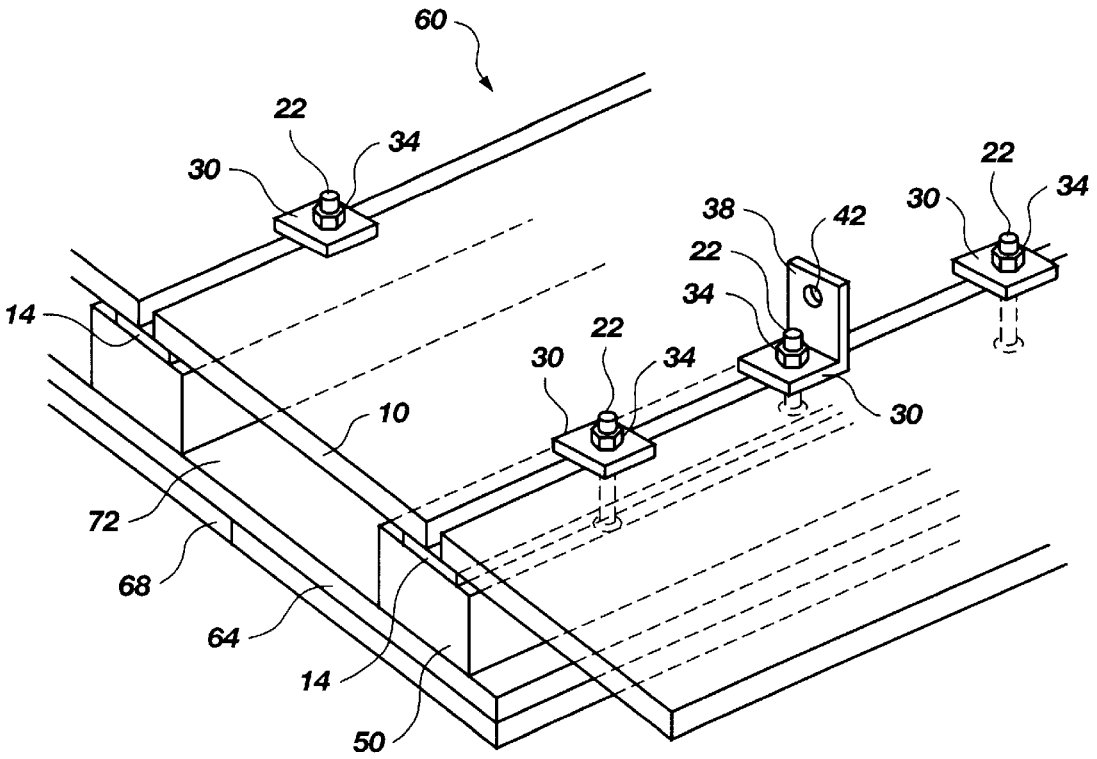
FIG. 5 shows a fragmented perspective view of a suspendable baffle made from interconnecting plates in accordance with the principles of the present invention.

Referring now to FIG. 4, there is shown a front view of another embodiment of the invention. When using plate to form a baffle, a wood frame is attached to the plate and then covered with other materials. A more complete baffle is shown in FIG. 5. In order to hold the wood frame 50 to the plates 10, several holes 54 are formed in the wood frame and in the facing strips 14. Typically, the wood frame 50 will be made of two by four studs which extend the length of the facing strip 14, and will be attached by a carriage bolt extending through the facing strip, between the plates 10, and the backing washer, not shown, terminating in a nut. It will be appreciated that the studs could also extend from facing strip to facing strip in a transverse manner. This method of fabrication simulates conventional building construction and allows the attachment of realistic walls, ceilings, doors and the like, to the bullet stop, thereby allowing a great deal of versatility of environmental simulation.

Referring now to FIG. 5, there is shown an end view of a baffle, generally indicated at 60. The baffle 60 includes the plates 10 which are held together by a clamping arrangement between the facing strips 14 and the backing washers 30. The backing washers 30 and the facing strips 14 are held in the clamping arrangement by the bolts 22 and the nuts 34. One of the backing washers 30 also includes a flange 38 with a suspension hole 42 formed therein.

Beneath the facing strips 42 is the wood frame 50 formed of two by four wooden studs. Obviously, thicker pieces of wood could be used. Attached to the wood frame 50 are sheets of plywood 64. Acoustic tile, sheet rock or other conventional building material 68 may be attached to the plywood 64 using conventional means, thereby giving the baffle the appearance of a regular ceiling, wall or the like. When all of the pieces are attached, the baffle 60 can be suspended by the hole 42 (and other holes) and appears as a regular ceiling, wall, or the like.

This arrangement leaves air gaps 72 which have been traditionally desirable in the implementations of bullet traps. If a bullet is fired into the baffle, etc., it will travel through the acoustic tile 68 and the plywood 64 before striking the plate 10. Instead of ricocheting and possibly injuring persons or property, the fragmented and arrested bullet will fall against the plywood 64 and ultimately slide to the bottom of the gap 72. This arrangement creates the soft, sound-absorbing, attractive ceiling or wall traditionally associated with a normal human environment. Bullets and fragments are collected at the base of the construction. Any remaining fragments in the plywood or other materials can be collected by burning the materials and collecting the ash for proper disposal or recycling. It will be appreciated that this method of retention and collection of lead bullets and fragments is environmentally sound.

Ceiling baffles are traditionally made up of specifically manufactured panels of plate which have attachments for suspension and for the connection of wood. These panels are presently known to be suspended independently, leaving dangerous gaps therebetween. The cost of custom manufacturing each individual piece is high. In addition, it is expensive to ship the custom manufactured panels to the construction site. By utilizing the teachings of the present invention, much of this cost can be eliminated. Only the relatively small connection components need fabricating. The standard plate material can be purchased and transported to the construction site directly from the manufacturer or held in inventory until needed. Because the fabrication method of the present invention uses standard plates, they are purchased at a relatively low cost and are replaceable and reusable.

Figure 6:
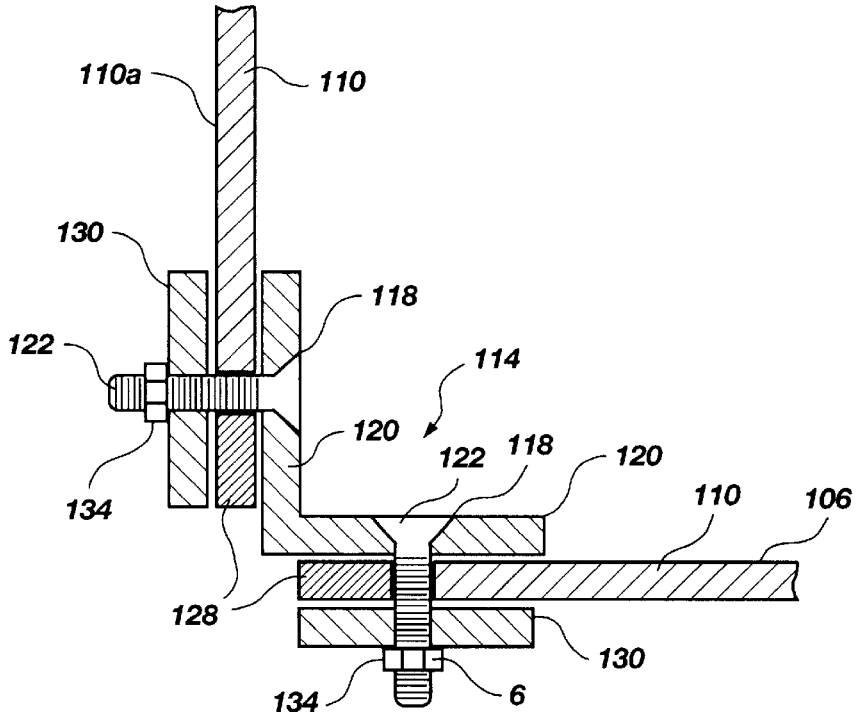
FIG. 6 shows a perspective view of interconnected plates joined perpendicular to one another in accordance with the principles of one aspect of the present invention.

In FIG. 6, there is shown a cross-sectional view of an embodiment of the present invention which allows plates 110 to be joined at transverse angles. Instead of being flat, the facing strip 114 is L-shaped and has holes 118 on each of the arms 120 through which the bolts 122 can extend to the backing washers 130. As with the prior embodiments, a nut 134 is used to hold the washer backing 130 and the facing strip 114 in a clamping arrangement on the plates 110. However, because both plates 110 are not held beneath the same backing washer 130, some support needs to be provided so as to equalize the clamping pressure and thus securely hold the plates. This is provided by placing a shim 128 adjacent each bolt 122 so that at least part of the shim is opposite the plates 110. Preferably, the shims 128 should have approximately the same thickness as the plate 110 to which it is adjacent. If the thicknesses are substantially different, the plates 110 will not be properly held.

In addition to allowing the joinder of plates 110 at transverse angles, this embodiment of the invention enables the use of different thicknesses of plates. For example, if the generally vertical plate 110*a* was intended to be the primary impact plate, and the generally horizontal piece 110*b* was intended merely to stop bullets and fragments from ricocheting downwardly, the horizontal piece 110*b* could be made of thinner, less expensive plate, thus reducing the overall cost of the device.

Figure 7:
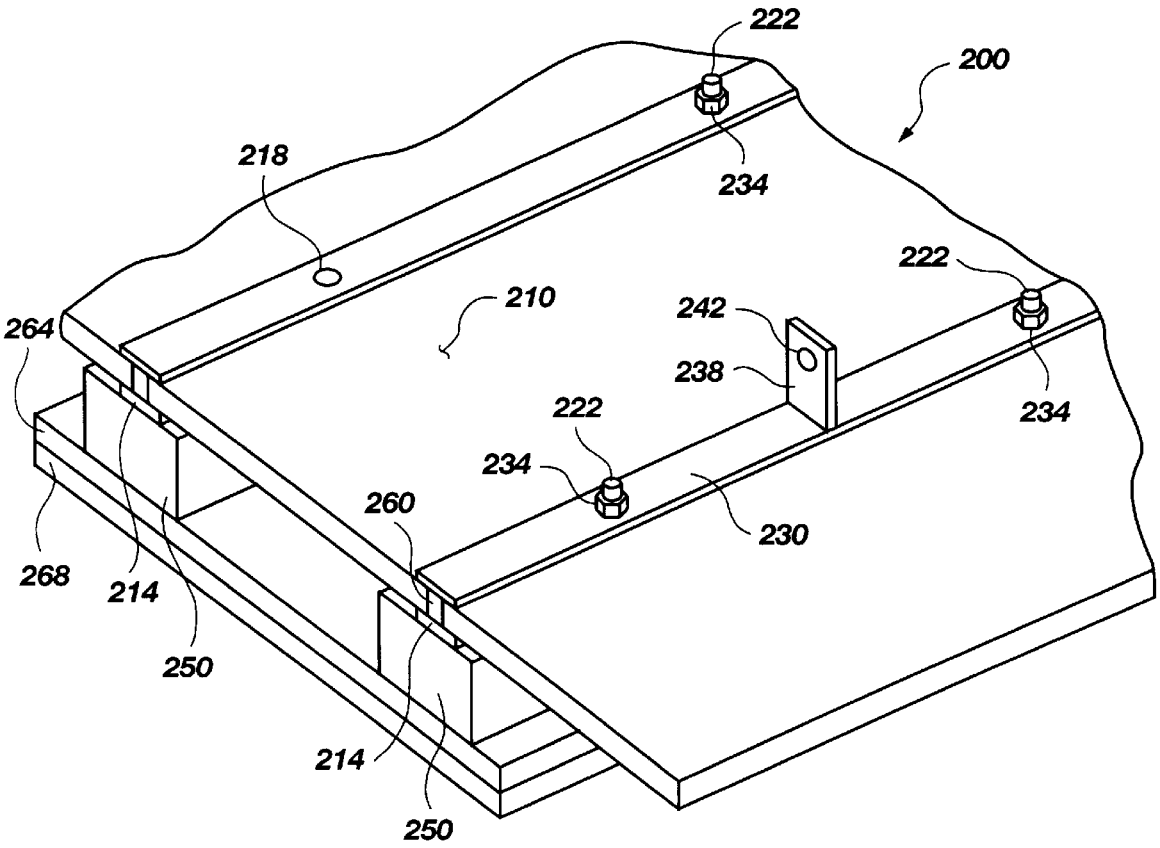
FIG. 7 shows a fragmented side perspective view of a baffle made in accordance with the principles of the present invention.

In FIG. 7, there is shown a baffle 200 made in accordance with yet another embodiment of the present invention. The baffle 200 has plates 210 and facing strips 214 as with the other embodiments of the invention. A wood frame 250 is attached to the facing strips 214 so as to support pieces of plywood, 264 and acoustic tile or other conventional building material 268. The primary difference in the present embodiment is that the baffle 200 lacks the backing washers, 30 (FIG. 5). Instead, the embodiment uses backing strips 230 with a plurality of threaded holes 218 positioned therethrough. A bolt 222 extends from the facing strip 214 through the hole 218 in the backing strip 230. The holes 218 may be threaded or a nut 234 may be fastened on the bolt 222 so as to clamp the backing strip 230 and the facing strip 214 together and hold the plates 210 in place. A flange 238 with a suspension hole 242 can be attached to the backing strip to support the baffle 200.

The embodiment described has advantages over the embodiment discussed regarding FIG. 5. The elongate nature of the backing strip 230 provides more lateral support to the plates 210, than does the backing washer 130. Additionally, the flange 238 extending from the backing strip 230 has all of the bolts 222 along the backing strip holding the plate 210, as opposed to a single bolt 122 in FIG. 5. Furthermore, the backing strip 230 provides a secondary containment for bullet fragments from passing through the channel between the plates. Occasionally, when a bullet directly hits the junction between a facing strip 114 or 214 and a plate 110 or 210, fragments of the bullet no wider than that space may pass between the two and into the channel between the plates. By providing the backing strip 230, the possibility of such a fragment causing any damage to persons or property on the opposite side of the plates 210, is virtually eliminated.

In addition to joining plates side-to-side, it is also desirable to join plates in an end-to-end fashion, or in two dimensions as opposed to linearly. This can of course be accomplished by using the means described herein to join the sides of plates simultaneously with the ends. While this is advantageous, it may be advantageous in certain circumstances, such as where bullets are expected to travel generally in one direction, to orient all of the facing strips parallel to that direction. This arrangement prevents lateral impacts with the sides of the facing strips. This can be accomplished by bolting the ends of a backing strip with the end of a corresponding backing strip. It will be appreciated that a backing strip can be attached to a facing strip as well.

Additionally, the backing strip 230 defines a continuous space in which sand 260, foam, rubber, ridged spacers or sealant or some similar damping device can be disposed in the channel between the plates. Such materials will not only decrease the velocity of any fragments which pass between the facing strips 214 and plates 210, they also serve as a damper to decrease the passage of vibrational energy between the respective plates 210.

Figure 8:
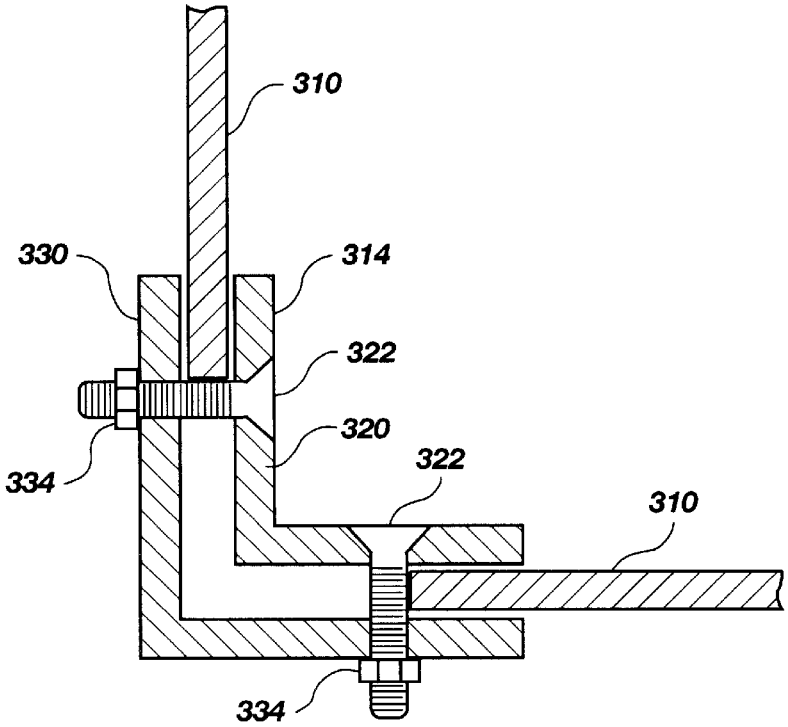
FIG. 8 shows a side, partial cross-sectional end view of another embodiment of the present invention.

Referring now to FIG. 8, there is shown yet another embodiment of the present invention. A pair of plates 310 are held in transverse orientation by a L-shaped facing strip 314. Bolts 322 extend through the facing strip 314 and through an L-shaped backing 330. The backing 330 can be washers or two backing strips as discussed previously, or preferably a single backing strip having an L-shaped cross-section, such as that shown. The backing 330 is held in place by nuts 334 which attach to the bolts 322.

Those skilled in the art will recognize numerous modifications which could be made to this embodiment. For example, the facing strip 314 could be formed at an angle other than 90 degrees to allow some other angular relationship between standard size plates 310.

Thus there is described a interconnect system for modularly fabricated bullet stops. Those skilled in the art will recognize numerous modifications which may be made without departing from the scope and spirit of the invention. The appended claims are invented to cover such obvious modifications.

What is claimed is:

1. An interconnect system for fabricating modular bullet deflecting devices, the system, when assembled, comprising:

a plurality of metallic plates, each plate having at least one lateral edge juxtaposed with a lateral edge of another metallic plate;

at least one facing strip disposed along the juxtaposed lateral edges of the plates so as to cover the juxtaposed lateral edges of the metallic plates;

clamp means releasably attached to the at least one facing strip for holding the facing strip in secure engagement with the metallic plates adjacent the lateral edges to apply a clamping force and thereby hold the metallic plates in rigid connection with one another and forming a continuously bullet resistant joint; and damping means for damping the transfer of vibrational energy between the plates.

2. The interconnect system according to claim 1, further comprising sealant disposed between the plates.

3. The interconnect system according to claim 1, wherein a rigid spacer is disposed between the plates.

4. An interconnect system for forming a modular bullet deflecting devices system comprising:

a plurality of metallic plates, each plate having at least one lateral edge juxtaposed with a lateral edge of another metallic plate;

at least one facing strip disposed along the juxtaposed lateral edges of the plates so as to cover the juxtaposed lateral edges of the metallic plates; and clamp means selectively attached to the at least one facing strip for holding the facing strip in secure engagement with the metallic plates adjacent the lateral edges to apply a clamping force and thereby hold the metallic plates in rigid connection with one another and forming a continuously bullet resistant joint of a modular bullet deflecting device; and bullet arresting means disposed adjacent to the plates for capturing bullets.

5. The interconnect system of claim 4, wherein the bullet arresting means comprises a frame disposed adjacent the plates and the joint, said frame configured to contain bullets from ricocheting off the plates.

6. The interconnect system of claim 5, wherein the frame comprises a wood frame attached to the facing strips and at least partially covering the plates.

7. The interconnect system of claim 5, wherein the frame includes a covering selected from the group consisting of acoustic tile and sheet rock.

8. An interconnect system for modularly fabricated bullet stops, the system comprising:

a plurality of bullet proof plates, each plate having at least one lateral edge juxtaposed with a lateral edge of another said plate so as to form a plurality of seams;

a plurality of facing strips formed from bullet proof material disposed along the seam between two adjacent said plates, each facing strip comprising an elongate metal strip with a plurality of holes;

backing means connected to the plurality of facing strips; and clamp means connected to the backing means and the facing strips for drawing the backing means and the facing strips toward one another so as to clamp the lateral edges of the plates between the facing means and the backing means and thereby form removable, bullet resistant joints at the seams; and a frame attached to the facing strip and spaced away from the plates so as to form a bullet containment means adjacent the plates.

9. The interconnect system of claim 8, wherein the frame is attached to the facing strip by the clamp means.

10. A method for constructing a modular bullet stopping device comprising:

a) positioning a pair of bullet proof plates adjacent one another so one lateral edge of each plate is juxtaposed at a lateral edge of the other plate;

b) placing a facing strip adjacent the juxtaposed edges to cover a channel between said edges;

c) placing a backing means adjacent the juxtaposed lateral edges of the plate on a side opposite the facing strip;

d) connecting the backing means to the facing strip so that the backing means and the facing means clamp together against the plates and thereby hold the plates in rigid orientation to one another and form a bullet resistant joint; and e) attaching a bullet containment frame to the modular bullet stopping device to contain ricocheting bullets.

11. The method according to claim 10, wherein the method comprises, more specifically, attaching the frame to the facing strip by the clamp means.

12. The method according to claim 11, wherein the method comprises, more specifically, attaching a plurality of wood members to a plurality of facing strips and connecting the wood members with material selected from the group consisting of acoustic tile, sheet rock and plywood.

13. An interconnect system for modularly fabricated bullet stops, the system comprising:

a plurality of bullet proof plates, each plate having at least one lateral edge juxtaposed with a lateral edge of another said plate so as to form a plurality of seams;

a plurality of facing strips formed from bullet proof material for disposal along the seam between two adjacent said plates, each facing strip comprising an elongate metal strip with a plurality of holes;

backing means connectable to the plurality of facing strips;

clamp means connected to the backing means and the facing strips for drawing the backing means and the facing strips toward one another so as to clamp the lateral edges of the plates between the facing means and the backing means; and a wood frame attachable to the facing strips and disposed so that at least a portion of the wood frame is spaced from the plates to thereby form a bullet containment area adjacent to the plates.

* * * * *

UNITED STATES PATENT AND TRADEMARK OFFICE

CERTIFICATE OF CORRECTION

PATENT NO. : 5,822,936
DATED : October 20, 1998
INVENTOR(S) : Kyle E. Bateman

It is certified that error appears in the above-identified patent and that said Letters Patent is hereby corrected as shown below:

Column 9,
Line 6, delete “facing strips” and insert -- at least one facing strip --.
Line 26, delete “facing means” and insert -- facing strips --.
Line 29, delete “facing strip” and insert -- facing strips --.
Line 33, delete “facing strip” and insert -- facing strips --.

Column 10,
Line 4, delete “facing means” and insert -- facing strip --.
Line 33, delete “facing means” and insert -- facing strips --.

Signed and Sealed this

Fourth Day of February, 2003

JAMES E. ROGAN
*Director of the United States Patent and Trademark Office*